US007464935B2

(12) United States Patent
Matusek et al.

(10) Patent No.: US 7,464,935 B2
(45) Date of Patent: Dec. 16, 2008

(54) MODIFIED POKER GAME

(76) Inventors: Ronald C. Matusek, 2000 Faywood St., Las Vegas, NV (US) 89134; Sharon Marie Reid, 2000 Faywood St., Las Vegas, NV (US) 89134

( * ) Notice: Subject to any disclaimer, the term of this patent is extended or adjusted under 35 U.S.C. 154(b) by 354 days.

(21) Appl. No.: 11/339,912

(22) Filed: Jan. 25, 2006

(65) Prior Publication Data

US 2007/0170651 A1 Jul. 26, 2007

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS 4,836,553 A 6/1989 Suttle et al.
5,288,081 A 2/1994 Breeding
5,718,430 A * 2/1998 Aramapakul et al. ..... 273/292
5,845,906 A 12/1998 Wirth
6,042,118 A 3/2000 Poitra
6,131,907 A 10/2000 Nucifora et al.
6,206,373 B1 3/2001 Garrod
6,517,072 B1 2/2003 McInerney
6,637,747 B1 10/2003 Garrod
6,896,265 B1 5/2005 Schlumbrecht
2001/0040345 A1 11/2001 Au-Yeung
2004/0036217 A1 2/2004 Schlumbrecht
2004/0183254 A1 9/2004 Schlumbrecht

FOREIGN PATENT DOCUMENTS

WO WO9964128 * 12/1999

OTHER PUBLICATIONS

Wikipedia, "Lame-brain Pete", p. 5, Jul. 31, 2004.*
Gambling Poker.com, "Lame Brain Pete Poker", Apr. 2, 2003.*

* cited by examiner

*Primary Examiner*—Benjamin H Layno
(74) *Attorney, Agent, or Firm*—Janine Rickman Novatt; Weiss & Moy, P.C.

(57) ABSTRACT

A gaming method is disclosed and comprises: providing at least one player with at least one pocket card; dealing three community cards; allowing the player to either check or place a bet before the third community card is dealt; and allowing the player to create a poker hand comprising: the pocket card, the third community card and either the first or second community card. The third community card or "key card" must be used by all remaining players and the dealer to form their poker hands. A gaming layout is also disclosed and comprises: at least one player position which is adapted to identify a player's set of cards and includes an ante location adapted to identify a player's ante; a first community card position; a second community card position; and a third community card position, wherein the first, second, and third community card positions are distinct from each other.

16 Claims, 3 Drawing Sheets

FIG. 3
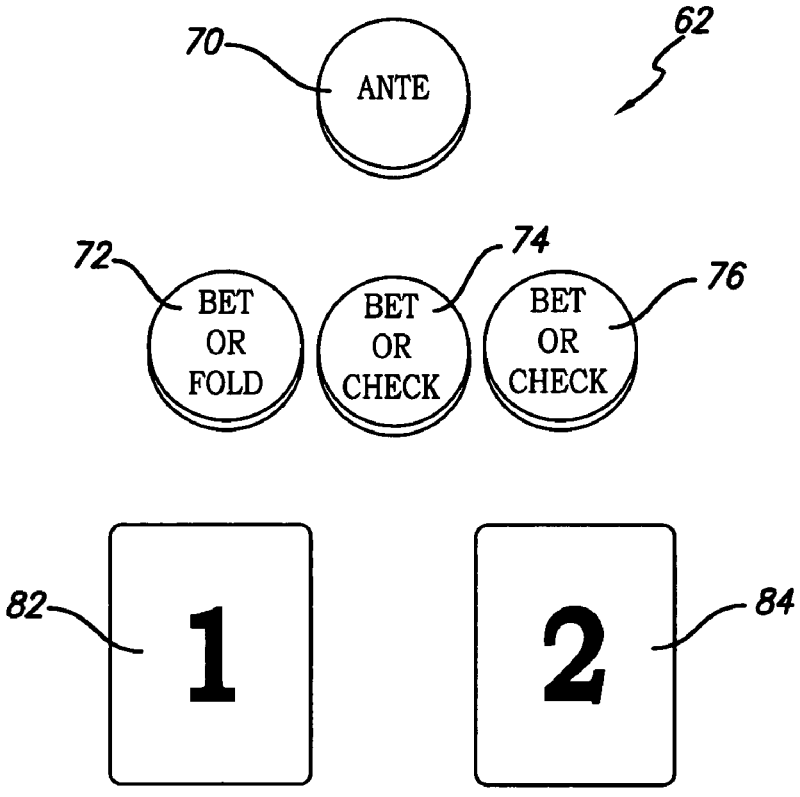
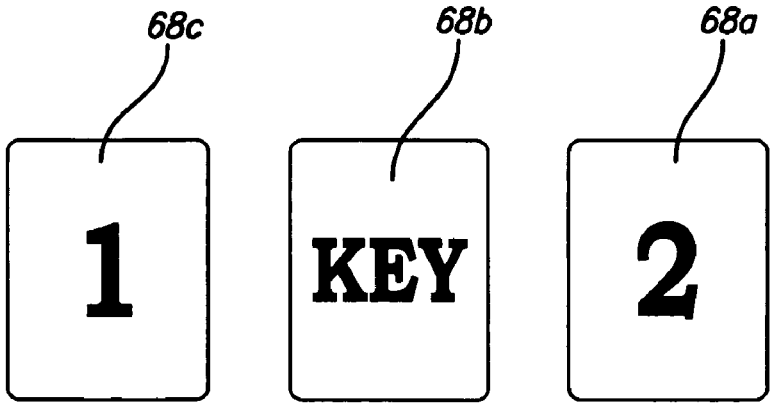
FIG. 4

MODIFIED POKER GAME

FIELD OF THE INVENTION

The present invention generally relates to a method and apparatus for playing a modified poker game. More particularly, the present invention relates to a modified poker game that may be played as a casino table game or as an electronic video game.

BACKGROUND

In recent years, a variety of modified poker games have become increasingly popular. There are numerous forms of poker and the main divisions include: draw poker, in which all of a player's cards are unknown to his opponents and stud poker, in which some of the player's cards are dealt face up and others are dealt face down. Within these two broad categories of poker, several variations exist. For example, "Texas Hold 'Em" is a well known modified poker game that is played in many casinos.

Although, games such as Texas Hold 'Em may be popular, such poker games have a number of drawbacks. For instance, one disadvantage with traditional poker games is that there is typically only one winner per round. Another disadvantage is that such poker games involve players competing against other players as opposed to players competing against the house. As such, profit margins of the house may be limited since the house must collect a percentage of the pot to make a profit. New players may also simply be too intimidated to play against other more experienced players. Furthermore, some poker games may not provide the player with sufficient betting opportunities which could lead to bigger payouts.

There is therefore a need in the art for a new modified poker game which allows multiple players to win against a dealer in a single round. There is also a need in the art for a modified poker game in which the players do not have to compete against each other but may compete only against the dealer. Further, there is a need in the art for an exciting and entertaining game that provides the player with opportunity for bigger payouts than conventional poker games.

SUMMARY

The present invention is directed to a method of playing a poker game which allows multiple players to win against a dealer in a single round. Providing players with more opportunities to win would bring excitement and interest to the players. In the method of the present invention, the players do not have to compete against each other but may compete only against the dealer. Competing against a dealer can be more enticing to new players as it may be less intimidating than playing against other more experienced players. Playing against a dealer may also create an atmosphere of camaraderie among the players and invoke a feeling of belonging together for the same cause, which is to beat the dealer. The present invention further adds excitement by providing multiple betting opportunities and opportunity for bigger payouts than conventional poker games.

To achieve the foregoing and in accordance with the purposes of the present invention, the present invention is directed to a gaming method which comprises: dealing at least one pocket card to at least one player; dealing three community cards; allowing the player to either check or place a bet before the third community card is dealt; and allowing the player to create a poker hand comprising: the pocket card, the third community card, and either the first or second community card.

One embodiment of the present invention is directed to a method of playing a modified poker game wherein at least one player plays against a dealer representing the house. The method of this embodiment of the invention comprises the following steps: (a) requiring each player to place a first ante bet before receiving any cards; (b) dealing three cards face down to each player and to the dealer, wherein each player is permitted to view the three cards; (c) requiring each player to decide whether to fold or to make a second bet; (d) dealing a first community card face up; (e) requiring each remaining player to decide whether to check or to make a third bet; (f) dealing a second community card face up; (g) requiring each remaining player to decide whether to check or to make a fourth bet; (h) dealing a third community card ("Key card") face up; and (i) determining game outcome by using poker rankings to make a comparison between each remaining player's five card hand and the dealer's five card hand. Each remaining player's five card hand and the dealer's five card hand is comprised of the following: (1) the three cards dealt face down in step "b", (2) the Key card, and (3) either the first community card or the second community card.

Another aspect of the present invention is directed to a gaming layout which includes: at least one player position which is adapted to identify a player's set of cards and includes an ante location adapted to identify a player's ante; a first community card position; a second community card position; and a third community card position, wherein the first, second, and third community card positions are distinct from each other.

The above description sets forth a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in further detail, it is to be understood that the invention is not limited in its application to the details of the construction and to the arrangement of the components set forth in the following description or as illustrated in the drawings. The invention is capable of other embodiments and of being practiced and carried out in various ways. Furthermore, it is to be understood that the phraseology and terminology employed herein are for the purpose of description and should not be regarded as limiting.

Other features, aspects and advantages of the present invention will become apparent from the following description of the invention, taken in conjunction with the accompanying drawings, which illustrate, by way of example, various features of embodiments of the invention.

BRIEF DESCRIPTION OF THE DRAWINGS

FIG. 3 is an enlarged view of a player position of the gaming layout of FIG. 2 in accordance with an embodiment of the present invention.

FIG. 4 is an enlarged view of the community card positions of the gaming layout of FIG. 2 in accordance with an embodiment of the present invention.

DESCRIPTION OF THE INVENTION

In the following description of embodiments of the invention, reference is made to the accompanying drawings, which form a part of this application. The drawings show, by way of illustration, specific embodiments in which the invention may be practiced. It is to be understood that other embodiments may be utilized and modifications may be made without departing from the scope of the present invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It further will be understood by those of ordinary skill in the art that some steps may be omitted or added and still fall within the spirit of the invention.

Gaming Method

The present invention comprises a gaming method and devices that may be used to implement the gaming method. In general, the gaming method is designed to reward players who have compiled poker hands that are better than the dealer's poker hand. Each poker hand includes five cards. Traditional poker combinations and their corresponding ranks are used-namely (ranked in ascending order) pair, two pairs, three of a kind, straight, flushes, four of a kind, full house, straight flush, and royal flush.

In one embodiment, three initial or pocket cards are dealt face down to each player and to the dealer. A round of betting occurs, and then three community cards are dealt one by one. After each community card is dealt, the gaming method allows a round of betting to occur. A predetermined bet value per player is used for each betting round. Of the three community cards, one designated community card has to be used by all the players and the dealer to form their poker hands. A game outcome is determined by comparing each player's poker hand to the dealer's hand and using traditional poker combination rankings.

Figure 1:
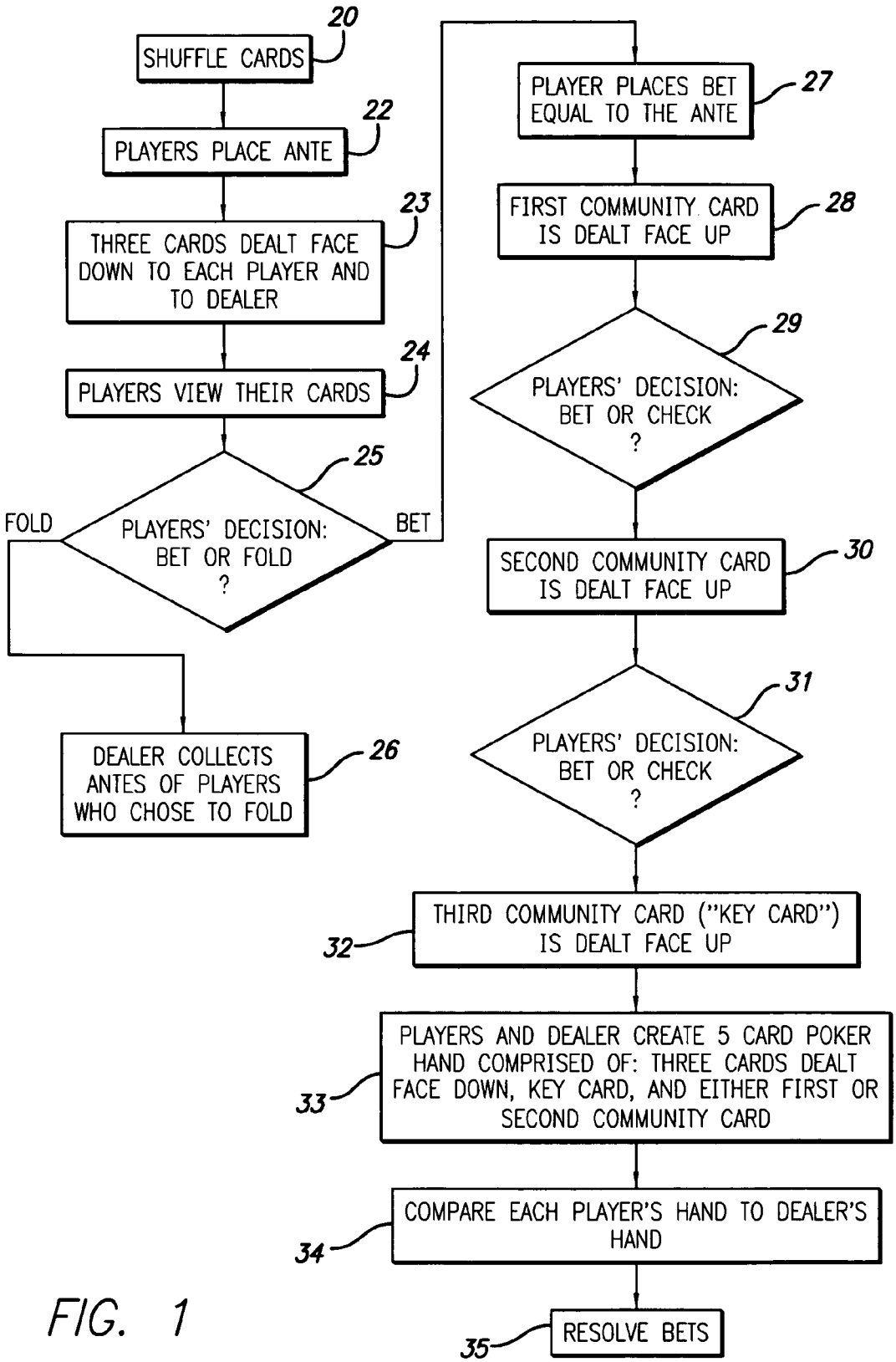
FIG. 1 depicts a flowchart showing substantially the steps of a gaming method in accordance with an embodiment of the present invention.

Referring to FIG. 1, in one embodiment of the present invention, the gaming method of the invention begins with a dealer shuffling a set of cards (step 20). A single deck or multiple decks of cards may be used. The players are then asked to place an ante to participate in the game (step 22). After the dealer shuffles the cards and the players have placed their antes, the dealer deals three cards face down to each player and to the dealer (step 23). The players are allowed to view their cards (step 24). In one embodiment of the present invention, the players compete only against the dealer and the players do not compete against the other players. Thus, the players may realize that there would almost be no negative consequence if they were to show their cards to other players, and it may be to their disadvantage if they show their cards to the dealer.

Next, at step 25, each player is offered two options—whether to fold or to place an additional bet. If the player decides to fold, the player terminates participating in the game and the dealer collects that player's ante (step 26). However, if the player decides to place an additional bet, the player is asked to bet an amount that is preferably equal to the ante (step 27). In alternate embodiments of the invention, the bet amount may be varied as desired. For instance, the bet amount may be twice the ante, thrice the ante, or half of the ante. The bet amount may also be a specific amount, such as $10.00 or $25.00.

The game continues for the players who have placed an additional bet. Prior to step 28, the dealer may set aside one card (hereinafter referred to as "burning" a card). It can be realized that if a card is burned, the outcome may be more challenging to predict, as only some cards are used during play and the game indicia of some cards cannot be seen by the players. It is noted, however, that burning a card may be omitted as desired in alternate embodiments of the invention.

With continued reference to FIG. 1, the dealer then begins dealing community cards, which the players and the dealers use to create their poker hands. In step 28, the dealer deals the first community card face up. The first community card dealt may be referred to as the first face up card. The term "face up" card may be used to refer to a card that is laid out to the players and to the dealer such that the card's game indicia are visible to the players and the dealer. The first face up card is placed on a specific place on the gaming table labeled "1" (hereinafter "1 spot") to distinguish it from the subsequent community cards that will be dealt. Of course, various names and/or symbols may be used to designate the specific place for each community card. It can be realized at this point that the players may be able to evaluate the strength of their hands or their chances of winning, as they now have seen potentially four of the five cards that may be used to compose their final poker hand. Next, the player is given the option to place a bet or check (step 29). If the player decides to place a bet, the player places a bet preferably equal to the ante. If the player decides to check, then the player places no additional bet at this juncture.

Prior to step 30, the dealer may burn one card. Again, burning a card is optional and may be omitted. In step 30, the dealer deals a second community card, which may be referred to as the second face up card. The second face up card is placed on a specific place labeled "2" (hereinafter "2 spot") to distinguish it from other community cards. Of course, other labels may be used to designate the position for the second community card. It can be realized at this point that the players may be able to evaluate the strength of their hands as they may now have seen potentially four of the five cards that may comprise their final hand. Thus, the players can make an educated decision whether to bet in the next round of betting.

Next, the player is given the option to place a bet or check (step 31). If the player decides to place a bet, the player places a bet preferably equal to the ante. Of course, the required bet amount may be varied as desired. If the player decides to check, then the player places no additional bet at this juncture.

The dealer may then burn one card prior to step 32. In step 32, the dealer deals a third community card, which may be referred to as the third face up card. In the preferred embodiment, the third face up card is placed on a specific place which is labeled "Key" (hereinafter "Key spot"). Of course, any word and/or symbols may be used to designate the Key spot.

The players and the dealer are required to create a combination of five cards to produce their final poker hands (step 33). In one embodiment of the present invention, the gaming method requires all remaining players and the dealer to use a specific community card. In the preferred embodiment, all the remaining players and the dealer must include in their poker hand the following: (a) the three cards dealt face down to them, (b) the third community card ("Key card") which is the card placed on the Key spot, and (c) either the first or second community card. The player designates which community card he desires to use for his five card hand by placing his cards on a specially designated area of the game table. For instance, if the player wishes to use the first community card to form his five card hand (so that his five card hand comprises: the three cards dealt face down, the Key card and the first community card), then the player places his cards on a region of the player's position of the game table labeled "1" or "First" to indicate that he chooses to use the first community card (see FIGS. 2-3). Similarly, there may be another spot marked "2" or "Second" on the player's portion of the game table which indicates that the second community card is to be used to form the player's five card hand.

Next, each player's hand is compared against the dealer's hand (step 34). Game outcome is then determined and bets are resolved (step 35) using traditional poker combination rankings and a designated payout schedule.

In one embodiment of the present invention, if the player beats the dealer but the player's hand is less than a predetermined value (e.g., pair of 10's), a push is declared and the player is given back his ante. This rule may be omitted or modified with a different pair.

In one embodiment of the present invention, the following payout schedule may be used to resolve each player's bets:

TABLE 1

Payment Schedule A

| Final Hand | Pay (to 1) |
|---|---|
| Royal Flush | 100 |
| Straight Flush | 50 |
| 4 of a Kind | 15 |
| Full House | 6 |
| Flush | 5 |
| Straight | 4 |
| 3 of a Kind | 3 |
| Two Pair | 2 |
| A Pair of 10's or Better | 1 |

In an alternate embodiment of the present invention, the following payout schedule may be used:

TABLE 2

Payment Schedule B

| Final Hand | Pay (to 1) |
|---|---|
| Royal Flush | 200 |
| Straight Flush | 50 |
| 4 of a Kind | 15 |
| Full House | 6 |
| Flush | 5 |
| Straight | 4 |
| 3 of a Kind | 3 |
| Two Pair | 2 |
| A Pair of 10's or Better | 1 |

Of course, the payout schedule may be modified with different payout scales as desired. A maximum aggregate win per round may be made, such as $25,000.

In an alternate embodiment of the present invention, if the player does not have a pair of 10's or better, but the player beats the dealer, a push is declared and the player is given back his bet, but the dealer takes the player's ante. This variation of the invention would provide the house with larger profits. Nonetheless, this rule may be omitted or modified with a different pair or other predetermined ranking.

It can be realized from the steps depicted in FIG. 1 that the present invention provides a modified poker game that adds new excitement and more rewards than traditional poker games. The above-described embodiments of the present invention have many advantages. For instance, with the present invention, each player may compete against the dealer one-on-one, and thus more than one player may win per round. The embodiments that utilize the payout schedule, such as the payout schedules presented above, may provide the player with games that are more rewarding than traditional poker games. In traditional poker games, the payout is typically 1 to 1, whereas with the present invention, the payout can be 200 to 1 (see Table 2, Payment Schedule B).

It can further be realized that during the course of the game, betting may be more controlled and predictable with the present invention than with traditional poker games. The players may not be placed in a situation where they feel that the other players with more money or experience may intimidate them. It can also be realized that the present invention may use less cards and may provide a simpler game than traditional poker games. With traditional poker games, a total of five community cards may be presented to the player whereas less community cards may be provided with the present invention. Additionally, one of the three community cards is pre-selected to be a part of the poker hand of all the players and the dealer. Thus, the player selects one of the two community cards for use in creating his poker hand. This may allow game operators, such as casinos, to run more poker games per any given time.

As described in the Example section below, certain embodiments of the present invention have reasonable odds for both the player and the house. This is another advantage of the invention because, to be a viable casino game, the gaming method should provide opportunity for a reasonable return for both the house and the player.

It is to be understood, that although some advantages of the present invention are described herein, it is not necessary that all the advantageous features and/or all the advantages need to be incorporated into every embodiment of the invention.

Gaming Layout

Figure 2:
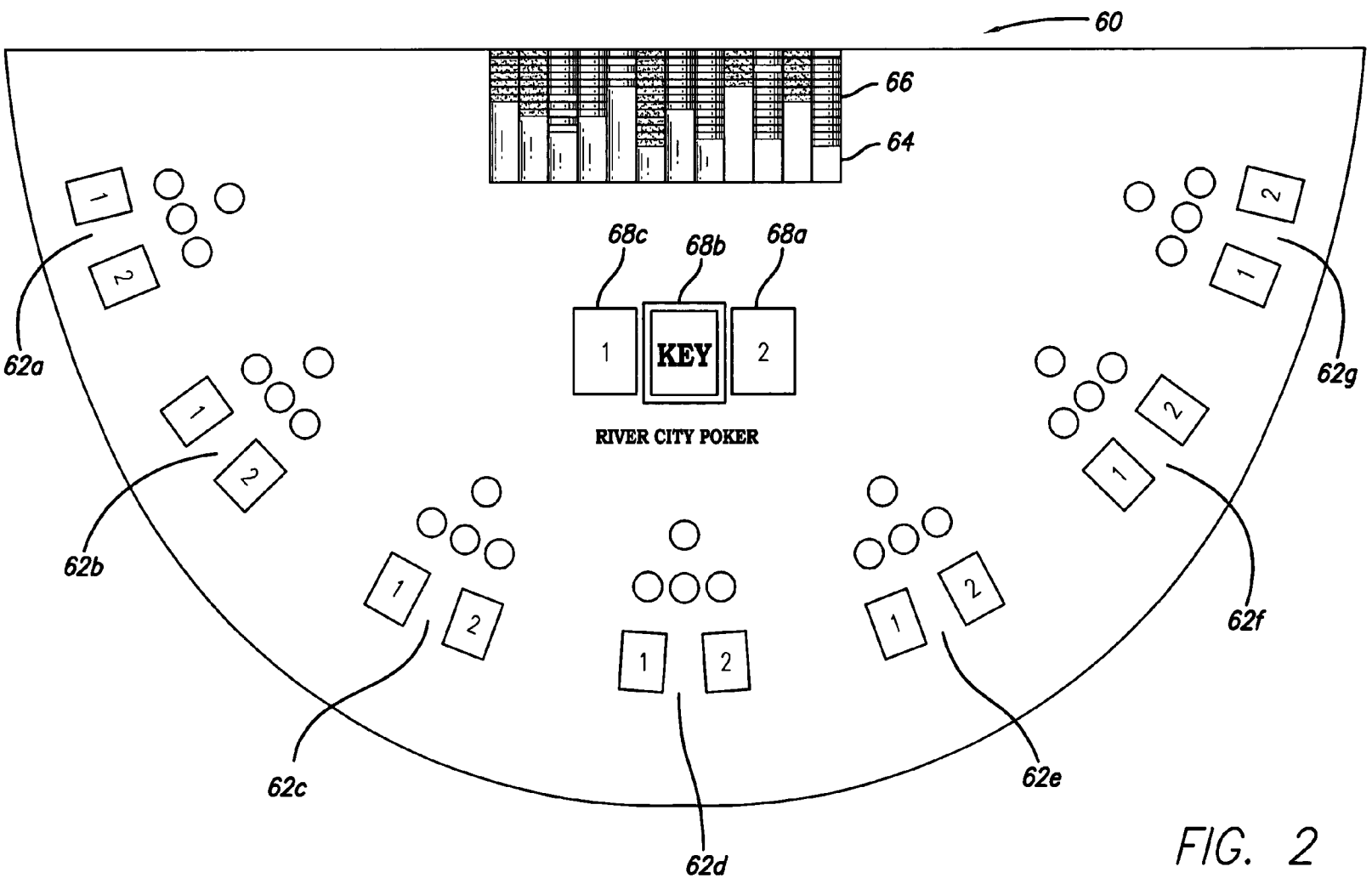
FIG. 2 depicts a top plan view of a gaming layout in accordance with an embodiment of the present invention.

Referring now to FIG. 2, an embodiment of a gaming layout 60 of the present invention is shown. Gaming layout 60 may be made with the common shapes of conventional casino gaming tables, such as a semi-circular shape. Gaming layout 60 may also be made with materials of conventional gaming tables, such as felt, plywood, or marble. In alternate embodiments of the present invention, gaming layout 60 may be a video representation of a conventional gaming table.

Gaming layout 60 includes a dealer position 64 where the dealer may store gaming chips 66 and place his cards. Gaming layout 60 also includes a plurality of community card positions 68*a*-*c*. Gaming layout 60 further includes a plurality of player positions 62*a*-*g*, which is adapted to distinguish each player's bets and cards from those of the other players. Although seven player positions are depicted in FIG. 2, any suitable number of player positions may be included in a gaming layout of the present invention. The number of player positions may vary depending on the size of the gaming table and the number of players a casino wishes to accommodate in one given game. Also, it is not necessary that all player positions be utilized while the game is being played.

Referring to FIG. 3, each player position 62 includes an ante position 70, which is where the player positions his initial bet, and betting positions 72, 74, and 76. During the course of the game and specifically prior to the distribution of the community cards, first subsequent betting position 72 is where the player positions his bet subsequent to his ante (after viewing the first set of cards dealt to him) should the player decide to place an additional bet and continue playing. Assuming the player plays until after all community cards are distributed, second subsequent position 74 is where the player positions his second subsequent bet, which is prompted after the revelation of the first community card and just prior to the distribution of the second community card. The player either places his bet on betting position 74 or checks. Third subsequent position 76 is where the player positions his third subsequent bet, which is prompted after the distribution of the second community card and just prior to the distribution of the third community card. The player either places his bet on betting position 76 or checks. Of course, the number, locations, and designs of betting positions may be adjusted as desired.

The player designates which community card he desires to use for his five card hand by placing his cards on a specially designated area of the game table. If the player wishes to use the first community card to form his five card hand (so that his five card hand comprises: the three cards dealt face down, the Key card, and the first community card), then the player places his cards on position 82 which is labeled "1" to indicate that he chooses to use the first community card. Similarly, if the player chooses to use the second community card for his five card hand (so that his five card hand comprises: the three cards dealt face down, the Key card, and the second community card), then the player places his cards on position 84 which is marked "2" to indicate that the second community card is to be used to form the player's five card hand.

Referring now to FIG. 4, gaming layout 60 includes three distinct community card positions 68*a-c* located substantially in the center of the gaming layout or the board. The three community card positions 68*a-c* are preferably separated and are individually adapted to identify each community card distributed during the course of the game. Community card position 68*c* is labeled "1" to indicate that the first community card should be placed thereon. Community card position 68*a* is labeled "2" to indicate that the second community card should be placed thereon. Community card position 68*b* is labeled "Key" to designate that the third community card should be placed thereon. The "Key" position designates the community card (i.e., "key card") that must be used by the dealer and all remaining players when forming their poker hands. Thus, according to an embodiment of the invention, the poker hands of each remaining players and the dealer is comprised of: (1) the three cards dealt face down, (2) the Key card, and (3) either the first or second community card.

EXAMPLE

In the following example, a standard deck of 52 cards is used and all players compete against the house dealer.

In this embodiment of the present invention, the player must make an ante bet before any cards are dealt. The dealer then deals each player and himself three cards face down. After looking at his three cards, the player has two choices: (1) fold the hand and forfeit the ante; or (2) make a "Flop" bet which is equal to the ante to stay in the game.

After all players have made their decisions concerning their Flop bet, the dealer deals a first community card face up in the middle of the table. The dealer places the first community card on a designated area in the middle of the table which is marked "1". After seeing the one-card flop, each player has the option to check or make an additional "Turn" bet equal to the ante. After all players have made their decisions concerning their Turn bet, the dealer deals a second community card face up. The dealer places the second community card on a designated area in the middle of the table which is marked "2". Again, each player has the option to check or make an additional "River" bet equal to the ante. The following table is a summary of this embodiment's betting structure.

TABLE 3

| Summary of Betting Structure |
|---|
| Make a 1 unit ante before the dealer deals three hole cards to each player. |
| Make a 1 unit Flop bet or fold before the dealer deals the first community card. |
| Make a 1 unit Turn bet or check before the dealer deals the second community card. |
| Make a 1 unit River bet or check before the dealer deals the final community card ("key card"). |

After all players have made their decisions concerning their River bet, the dealer deals the third and final community card which is called the "key" card and places it between the first and second community cards. From this point on no more betting is allowed. The dealer then exposes his three hole cards. Using their three cards and two of the three community cards, all the players and the dealer try to form their best five-card poker hand. However, one of the community cards selected for the five-card poker hand must be the key card.

The dealer then compares his hand with each of the players' hands. Whoever has the higher five-card poker hand wins. If the dealer's hand outranks the player's hand, the player loses all of his bets including the ante. If the player's hand outranks the dealer's hand, the player will be paid depending on whether his best five-card poker hand is a pair of 10 s or better. If the player's hand is less than a pair of 10 s, all his bets push and the ante is returned. If the player's hand is a pair of 10 s or better, he will be paid odds on all of his bets except the ante according to either Payment Schedule A (Table 1) or Payment Schedule B (Table 2) and the ante is returned. In the event of a tie, it is a push with no money changing hands.

Mathematical Analysis

The following mathematical analysis of the above-described embodiment was conducted by Gambology of Las Vegas, Nev.

METHODS

There are $C_{52,3}\times49\times48\times47\times C_{46,3}=22,100\times49\times48\times47\times15,180=37,085,080,032,000$ ways to cycle through all possible hand combinations of this embodiment. A computer program known as a combinatorial analyzer was written to deal and evaluate all of the hands in order to determine the optimal strategy and the player expectation. The algorithm for the analysis is described below.

(1) First of all, the analyzer would cycle through all 1,755 unique three-card hand combinations. There are 22,100 three-card hands but only 1,755 are unique.

(2) For each such three-card hand, draw each card from the remaining 49-card deck. (Even though 49 cards remain, there is no need to cycle through each of them. For example, if the player's 3 cards are all in the same suit then for each card value we only need to deal one card that is the same suit as the player's hand and one card that is not the same suit but properly weight the result by 3.) Draw each of all 48 cards from the remaining deck. Draw each of all 47 cards from the remaining deck. Finally draw all 3-card combinations from the remaining 46-card deck. (Again, there is no need to draw all 15,180 3-card hands from the remaining deck if the key card and any of the $1^{st}$ and $2^{nd}$ community cards are not suited.)

(3) Combine each player three-card hand with the key card and the first community card. Determine the ranking of the complete first five-card hand. Combine the same player three-card hand with the key card and the second community card. Determine the ranking of the complete second five-card hand. Compare the rankings of the first and second player five-card hands and pick the better one.

(4) Combine each dealer three-card hand with the key card and the first community card. Determine the ranking of the complete first five-card hand. Combine the same dealer three-card hand with the key card and the second community card.

Determine the ranking of the complete second five-card hand. Compare the rankings of the first and second dealer five-card hands and pick the better one.

(5) Compare the selected player hand with the selected dealer hand and determine the loss or payout. Pass the expected return back to the previous decision point (e.g., River to Turn, Turn to Flop, and Flop to ante).

(6) Accumulate the expected return at each decision point, assuming (i) the player has bet at the previous decision point and (ii) the player has checked at the previous point. Compare the expected returns for (i) and (ii) and select the better of the two.

(7) As soon as all player three-card hands have been examined, the player's expectation and the optimal strategy have been determined.

The results of the analysis for Payment Schedule A (Table 1) based on the number of bets (excluding the ante) are shown below. All figures except the payoffs are in percentages (%).

Results

TABLE 4

| | | 1 Bet | | | | |
|---|---|---|---|---|---|---|
| Final Hand | Pay | Win | Loss | Tie | Prob. | Return |
| Royal Flush | 100 | 0.00000000 | 0.00000000 | 0.00000000 | 0.000000 | 0.0000 |
| Straight Flush | 50 | 0.00000000 | 0.00000000 | 0.00000000 | 0.000000 | 0.0000 |
| 4 of a Kind | 15 | 0.00000000 | 0.00000000 | 0.00000000 | 0.000000 | 0.0000 |
| Full House | 6 | 0.00000000 | 0.00000000 | 0.00000000 | 0.000000 | 0.0000 |
| Flush | 5 | 0.00000000 | 0.00000000 | 0.00000000 | 0.000000 | 0.0000 |
| Straight | 4 | 0.19117834 | 0.00200465 | 0.00034188 | 0.193525 | 0.7607 |
| 3 of a Kind | 3 | 0.11942308 | 0.00606975 | 0.00007425 | 0.125567 | 0.3461 |
| Two Pair | 2 | 0.35207853 | 0.02529750 | 0.00029779 | 0.377674 | 0.6536 |
| A Pair of 10s or Better | 1 | 3.63297113 | 1.85273986 | 0.00759992 | 5.493311 | −0.0725 |
| Nothing | 0 | 11.59909869 | 27.10313539 | 0.06449503 | 38.766729 | −54.2063 |
| Total | | 15.89474978 | 28.98924714 | 0.07280888 | 44.956806 | −52.5184 |

TABLE 5

| | | 2 Bets | | | | |
|---|---|---|---|---|---|---|
| Final Hand | Pay | Win | Loss | Tie | Prob. | Return |
| Royal Flush | 100 | 0.00000000 | 0.00000000 | 0.00000000 | 0.000000 | 0.0000 |
| Straight Flush | 50 | 0.00051477 | 0.00000000 | 0.00000000 | 0.000515 | 0.0515 |
| 4 of a Kind | 15 | 0.00000000 | 0.00000000 | 0.00000000 | 0.000000 | 0.0000 |
| Full House | 6 | 0.00000000 | 0.00000000 | 0.00000000 | 0.000000 | 0.0000 |
| Flush | 5 | 0.10135184 | 0.00056225 | 0.00000000 | 0.101914 | 1.0118 |
| Straight | 4 | 0.16246782 | 0.00156817 | 0.00031093 | 0.164347 | 1.2950 |
| 3 of a Kind | 3 | 0.53380122 | 0.02221137 | 0.00024198 | 0.556255 | 3.1362 |
| Two Pair | 2 | 1.65323419 | 0.19623670 | 0.00107129 | 1.850542 | 6.0242 |
| A Pair of 10s or Better | 1 | 3.10853655 | 1.00085184 | 0.00489840 | 4.114287 | 3.2145 |
| Nothing | 0 | 4.15222115 | 4.29990280 | 0.00823908 | 8.460363 | −12.8997 |
| Total | | 9.71212755 | 5.52133314 | 0.01476168 | 15.248222 | +1.8336 |

TABLE 6

| | | 3 Bets | | | | |
|---|---|---|---|---|---|---|
| Final Hand | Pay | Win | Loss | Tie | Prob. | Return |
| Royal Flush | 100 | 0.00030782 | 0.00000000 | 0.00000000 | 0.000308 | 0.0923 |
| Straight Flush | 50 | 0.00224377 | 0.00000001 | 0.00000000 | 0.002244 | 0.3366 |
| 4 of a Kind | 15 | 0.04321354 | 0.00000375 | 0.00000000 | 0.043217 | 1.9446 |
| Full House | 6 | 0.27710847 | 0.00058026 | 0.00000533 | 0.277694 | 4.9856 |
| Flush | 5 | 0.25628755 | 0.00117484 | 0.00000000 | 0.257462 | 3.8396 |

TABLE 6-continued

| | | 3 Bets | | | | |
|---|---|---|---|---|---|---|
| Final Hand | Pay | Win | Loss | Tie | Prob. | Return |
| Straight | 4 | 0.23694580 | 0.00223982 | 0.00054595 | 0.239732 | 2.8344 |
| 3 of a Kind | 3 | 2.32995212 | 0.06815118 | 0.00027438 | 2.398378 | 20.6970 |
| Two Pair | 2 | 4.48127095 | 0.48445451 | 0.00153346 | 4.967259 | 24.9498 |
| A Pair of 10s or Better | 1 | 7.77566851 | 2.06924066 | 0.00719845 | 9.852108 | 15.0500 |
| Nothing | 0 | 4.93493192 | 3.51185464 | 0.00661673 | 8.453403 | −14.0474 |
| Total | | 20.33793045 | 6.13769968 | 0.01617429 | 26.491804 | +60.6825 |

Accordingly, the player will fold 13.3032%, win 45.9448%, lose 40.6483% and tie 0.1037% of the time.

The player's expectation of the ante can be computed by adding the expectations above:

−13.3032%(fold)−52.5184% (1 bet)+1.8336% (2 bets)+60.6825% (3 bets)=−3.3055%.

The player's average bet will be 2.5493 units, so the player's expectation per total wager is −3.3055%/2.5493=−1.2966%.

If Payment Schedule B (Table 2) is used, then the player's expectation is −3.2131% of the ante or −1.2604% per total wager.

Although the present invention has been described above in considerable detail with reference to certain versions thereof, other versions are possible. For example, the gaming method described above is not limited to being played as a table game. The gaming method may be played using computers or electronic devices having audio and video outputs. Thus, the term "cards" as used in this application refers to traditional cards made of paper stock having traditional game indicia, such as numbers (2-10), suits (diamonds, hearts, spades, and cloves), and characters (aces, jacks, queens, and kings). The term "cards" is also used to refer to electronic images of traditional cards. The term "dealer" may be an actual person distributing the cards. It is noted that the dealer may also be a player, and the dealer does not have to be associated with a business entity having a stake in any profits derived from operating the game. The term "dealer" may also be used to refer to a virtual dealer that is programmed through a computer.

Additionally, some steps of the gaming method described herein may be added, omitted or modified. For instance, the steps of burning a card before dealing the first, second, and/or third face up card may be omitted. In alternate embodiments of the invention, players may also play against other players for a pot if a pot bet is incorporated into the game. In such embodiments, the player with the highest ranking hand wins the pot.

Yet, in other embodiments, additional key cards (i.e., cards that must be used to form the players and dealer's poker hand) may be incorporated into the game. Additional or less community cards may be dealt in alternate embodiments. Wild cards may also be used in the game. Also, the players may make a side wager for a progressive jackpot in alternate embodiments of the invention.

While the description above refers to particular embodiments of the present invention, it will be understood that many modifications may be made without departing from the spirit thereof. The presently disclosed embodiments are therefore to be considered in all respects as illustrative and not restrictive.

What is claimed is:

1. A method of playing a modified poker game, the method comprising;

a. dealing at least one pocket card to at least one player;

b. dealing a first community card, a second community card and a third community card;

c. allowing the player to either check or to place a bet before the third community card is dealt; and d. requiring the player to select either the first or the second community card to create a poker hand comprising the at least one pocket card, the third community card, and either the first community card or the second community card.

2. The method of claim 1, further comprising designating the third community card as a card that must be used by the player to create the poker hand.

3. The method of claim 1, further comprising providing the player the option to check or to place a bet before the second community card is dealt.

4. The method of claim 1, further comprising predefining a payout for a traditional poker combination.

5. The method of claim 1, further comprising requiring an ante from the player.

6. The method of claim 5, wherein if the player chooses to bet instead of choosing to check, the bet amount is equal to the ante.

7. The method of claim 1, further comprising determining a game outcome by comparing poker hands of two players, wherein one of the two players is designated as a dealer.

8. The method of claim 1, further comprising providing a gaming layout for playing the modified poker game, said gaming layout comprising:

a. at least one player position, the player position adapted to identify a player's set of cards;

b. a first position for the first community card;

c. a second position for the second community card; and d. a third position for the third community card, wherein the first position, second position, and third position are distinct from each other and the third position is adapted to designate a card that must be used to form the player's hand.

9. A method of playing a modified poker game wherein at least one player plays against a dealer representing the house, the method comprising;

a. requiring each player to place a first ante bet before receiving any cards;

b. dealing three cards face down to each player and to the dealer, wherein each player is permitted to view the three cards;

c. requiring each player to decide whether to fold or to make a second bet;

d. dealing a first community card face up;

e. requiring each player who made the second bet to decide whether to check or to make a third bet;

f. dealing a second community card face up;

g. requiring each player who made the second bet to decide whether to check or to make a fourth bet;

h. dealing a third community card face up;

i. determining game outcome by using poker rankings to make a comparison between each remaining player's five card hand and the dealer'five card hand, wherein each remaining player having a five card hand with a higher poker ranking than the dealer's five card hand beats the dealer's five card hand;

wherein requiring that each remaining player's five card hand and the dealer's five card hand is each comprised of: (i) the three cards dealt in step "b", (ii) the third community card, and (iii) either the first community card or the second community card.

10. The method of claim 9 wherein the second bet, third bet and fourth bet are each equal to the first ante bet.

11. The method of claim 9 wherein if the player's five card hand does not outrank a predetermined ranking but the player's five card hand beats the dealer's five card hand based on poker rankings, it is a push and the first ante bet, second bet, third bet and fourth bet are returned to the player.

12. The method of claim 11 wherein the predetermined ranking is at least a pair of 10's.

13. The method of claim 9, further comprising predefining a payout schedule for a traditional poker combination.

14. The method of claim 13 wherein the payout schedule is as follows:

| Final Hand | Pay (to 1) |
|---|---|
| Royal Flush | 100 |
| Straight Flush | 50 |
| 4 of a Kind | 15 |
| Full House | 6 |

-continued

| Final Hand | Pay (to 1) |
|---|---|
| Flush | 5 |
| Straight | 4 |
| 3 of a Kind | 3 |
| Two Pair | 2 |
| A Pair of 10's or Better | 1. |

15. The method of claim 13 wherein the payout schedule is as follows:

| Final Hand | Pay (to 1) |
|---|---|
| Royal Flush | 200 |
| Straight Flush | 50 |
| 4 of a Kind | 15 |
| Full House | 6 |
| Flush | 5 |
| Straight | 4 |
| 3 of a Kind | 3 |
| Two Pair | 2 |
| A Pair of 10's or Better | 1. |

16. The method of claim 9, further comprising providing a gaming layout for playing the modified poker game, said gaming layout comprising:

a. at least one player position, the player position comprising an ante betting position, a second betting position, a third betting position and a fourth betting position;

b. a first position for the first community card;

c. a second position for the second community card; and d. a third position for the third community card, wherein the first position, second position, and third position are distinct from each other.

* * * * *